US006334291B1

(12) United States Patent
Lelievre

(10) Patent No.: US 6,334,291 B1
(45) Date of Patent: Jan. 1, 2002

(54) STIRRUP FOR HORSEBACK RIDING

(75) Inventor: Patrick Lelievre, Olwisheim (FR)

(73) Assignee: UKAL (Societe Anonyme), Haguenau (FR)

( * ) Notice: Subject to any disclaimer, the term of this patent is extended or adjusted under 35 U.S.C. 154(b) by 0 days.

(21) Appl. No.: 09/473,700

(22) Filed: Dec. 29, 1999

(30) Foreign Application Priority Data

Dec. 30, 1998 (FR) ..... 98 16753

(51) Int. Cl.[7] ..... B68C 3/02
(52) U.S. Cl. ..... 54/47; 54/49
(58) Field of Search ..... 54/47, 49, 49.5, 54/48

(56) References Cited

U.S. PATENT DOCUMENTS 16,032 A * 11/1856 Trussell
445,411 A * 1/1891 Pearson et al.
699,472 A * 5/1902 Aughey et al.
717,850 A * 1/1903 Hey et al.
6,026,633 A * 2/2000 Burke, Jr. ..... 54/47

FOREIGN PATENT DOCUMENTS

DE 40184 2/1887

* cited by examiner

*Primary Examiner*—Charles T. Jordan
*Assistant Examiner*—Yvonne R. Abbott
(74) *Attorney, Agent, or Firm*—Young & Thompson

(57) ABSTRACT

Stirrup for horseback riding formed by two branches connected to the ends of a bearing support (tread) for the foot of the rider mounted pivotably about an axis connecting the two branches, characterized in that the bearing support (3) is also mounted with a possibility of vertical or substantially vertical movement relative to the branches (2) of the stirrup (1). The stirrup can be used in the field of horseback riding, in particular for facilitating teaching or practicr of horseback riding.

12 Claims, 3 Drawing Sheets

1
2
4
11
8
7
5
12
10
9
6
3'
3
8
12

STIRRUP FOR HORSEBACK RIDING

FIELD OF THE INVENTION

The present invention relates to the field of horseback riding, in particular as to accessories for the practice of horseback riding and more particularly as to stirrups.

BACKGROUND OF THE INVENTION

In horseback riding, the rider is subjected, at each stride and each jump of his mount, to the movements of his horse. The pressure exerted by the movement of the horse on the rider can be broken down into a vertical component and a horizontal component of pressure.

To adsorb the different components as well as the resultant, the rider smooths out the movements of the horse with his hips and his ankles when seated and with his knees and his ankles when jumping. When clearing an obstacle in the course of a jump, the contact of the pelvis of the rider with the saddle is avoided, the only thing bearing the rider being the stirrups. As a result, the stability of the rider and the precision of jumping are directly dependent on the quality of these latter.

There are known at present, in this field, two types of stirrups, namely fixed stirrups and articulated stirrups.

In the first category, the rigidity of the stirrup does not permit any shock absorption. At best, the work of the ankle is made more easy by an inclined stirrup tread.

In the second category of articulated stirrups, there can be cited those which have articulated branches ensleeved in rubber to give a certain spring effect. The downward pressure of the ankle of the rider is then facilitated and a slight shock absorbing effect absorbs minor shocks as well as a small portion of the amplitude of the more important shocks. However, the articulation of this type of stirrup, which is located on the two branches, has a tendency mechanically to push the tread of the stirrup and hence the leg of the rider forwardly, in a relatively large way, which is very unfavorable for his stability as well as for the precision of jumping.

In stirrups with articulated pads or treads, the ankle works without advancing the leg. However, the tread of this type of stirrup always ends up in rigid abutment, which again renders the stirrup fixed and hence the mechanism completely inoperative. Moreover, in certain versions, the tread swings as easily forwardly as rearwardly, which results in the stirrup having the reverse of the desired stabilization effect.

Finally, there exist stirrups whose tread pivots only to one side, the movement of the tread being returned by a spring mechanism. The pivotal movement of these treads is also limited by an abutment on the side toward which the tread swings, which again decreases its interest. This type of tread even has the tendency, by the return effect of the spring mechanism, to press the foot of the rider in an undesirable direction, or to do likewise such that the tread comes into poor orientation relative to the sole of the foot of the rider when the contact of the tread with the foot is interrupted during a short period during which the spring returns the tread to the horizontal position. These phenomena have therefore a tendency to destabilize the rider instead of giving him increased control and safety.

Moreover, this type of stirrup is up to 75% heavier than a conventional non-articulated stirrup and therefore requires a certain period of adaptation on the part of the rider. Finally, these stirrups are also more cumbersome than conventional stirrups.

From the above, it follows that none of the known stirrups takes account of the vertical pressure of the rider, nor of the work of the knees of this latter.

SUMMARY OF THE INVENTION

The present invention has for its object to overcome at least certain of these drawbacks.

To this end, it has for its object a stirrup for horseback riding, formed by two branches connected to the ends of a bearing support (tread) for the foot of the rider mounted pivotably about an axle connecting the two branches, characterized in that said bearing support is also mounted for vertical or substantially vertical displacement relative to said branches of the stirrup.

This stirrup absorbs the principal shocks without offering rigid resistance. The tread of the stirrup slides vertically without advancing. The stirrup of the present invention thus promotes the inclination of the bearing support (tread) from the good side and maintains the leg in place. The resilient suspension means with which the stirrup of the present invention is provided, absorbs the enormous shocks created by the striking and landing while jumping obstacles.

BRIEF DESCRIPTION OF THE DRAWINGS

The invention will be better understood, from the following description, which relates to a preferred embodiment, given by way of non-limiting example, and explained with reference to the accompanying schematic drawings, in which.

DETAILED DESCRIPTION OF THE INVENTION

FIGS. 1 to 4 show, by way of non-limiting example, a preferred embodiment of stirrup 1 according to the present invention.

Figure 1:
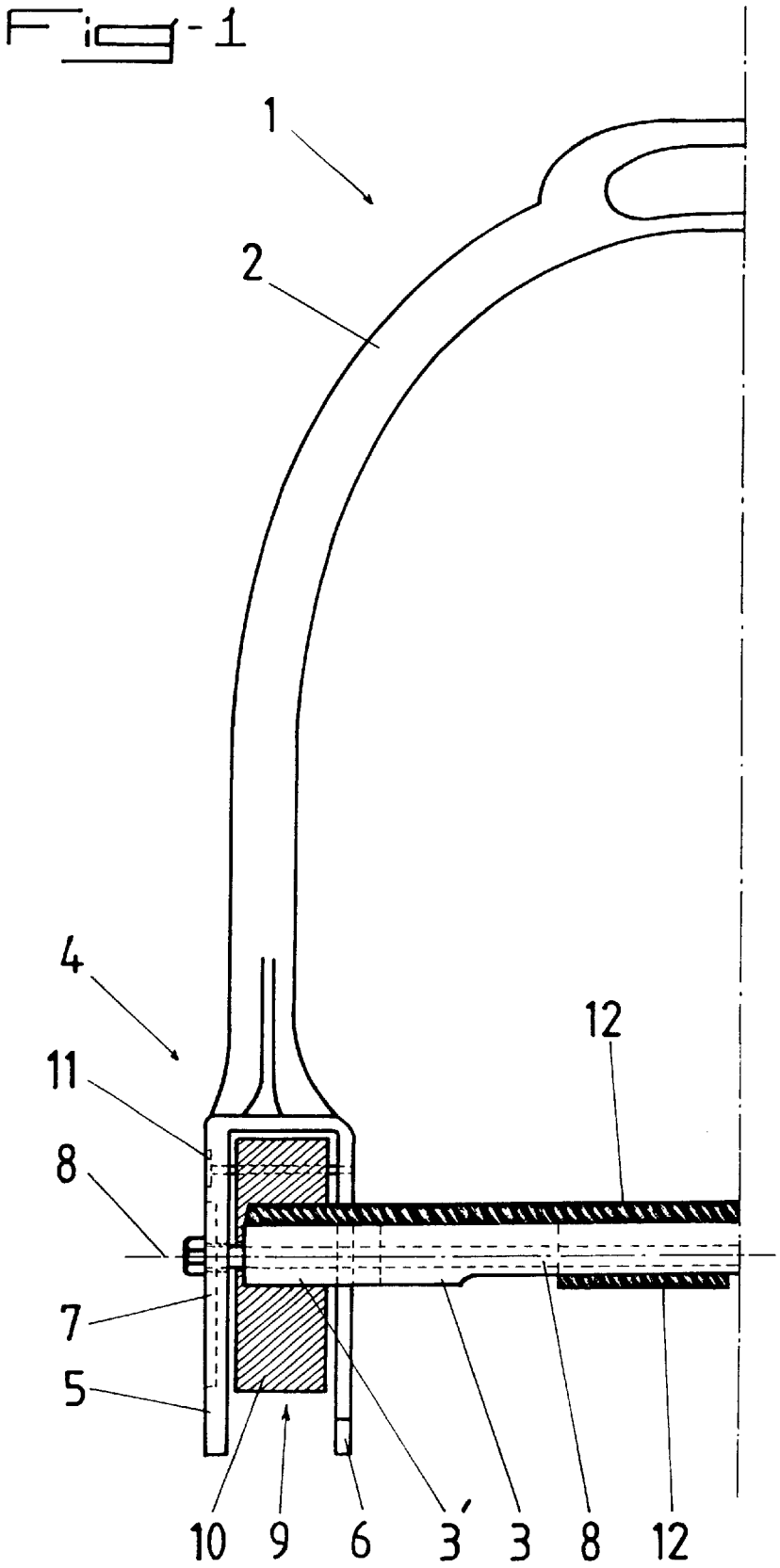
FIG. 1 is a fragmentary front view of one embodiment of stirrup according to the present invention.
Figure 3:
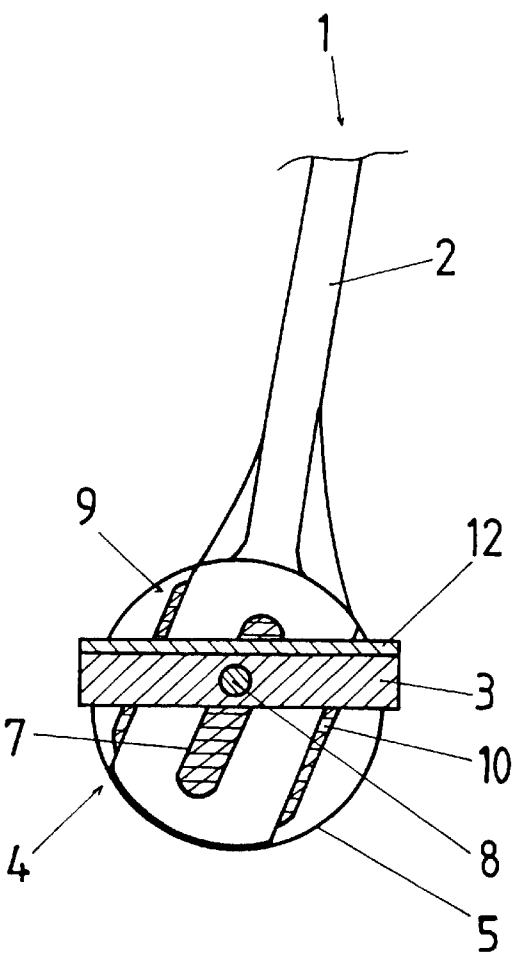
FIG. 3 is a fragmentary side view from within the stirrup of FIG. 1.

As shown in particular in FIG. 1, the stirrup 1 for horseback riding is formed of two branches 2 connected to the ends of a bearing support 3 (tread) for the foot of the rider mounted pivotably about an axle 8 directing the two branches 2, said bearing support 3 being also mounted for vertical or substantially vertical displacement relative to said branches 2 of the stirrup 1.

The axle 8 can be a material axle, for example, a rod of cylindrical cross-section passing through the bearing support 3 from side to side as in the preferred embodiment shown in FIG. 1.

In an embodiment (not shown), the axle 8 of pivoting of the bearing support 3 can also be replaced by an imaginary axis, the bearing support 3 being then retained on the end plates 5, 6 of the branches 2 of the stirrup 1 by the bias of lug coacting with reception sites for the lugs, disposed for example on the side walls of said terminal plates 5, 6.

Of course, said lugs can also be located on the end plates 5, 6, their reception sites being then directly formed in the bearing support 3. However, it will be noted that the modification comprising the material axle 8 has an advantageous effect on the solidity of the stirrup 1.

As shown in FIG. 1, the passage of a symmetrical material axle 8 also permits fixing in a central manner an anti-skid sole 12 on the bearing support 3, as will be described later.

According to one characteristic of the invention, each branch 2 of the stirrup 1 comprises, at its end 4, at least one end plate 5, 6 comprising an oblong hole or slot 7 extending substantially vertically relative to said branches 2 and adapted to receive a corresponding end of the bearing support 3 or one end of a through axle 8 pivotally carrying said bearing support 3.

This oblong hole or slot 7 permits vertical or substantially vertical displacement of the axle 8 of the bearing support 3 relative to the branches 2 of the stirrup 1. In cooperation with a shock absorbing and limiting means, the movement of said axle 8 is also controlled in its course within the oblong hole or slot 7, which imparts stability and comfort to the rider during the course of his mount and above all when jumping.

In the preferred embodiment shown in FIGS. 1 to 4, each branch 2 comprises at its end 4 two end plates 5, 6 each comprising an oblong hole or slot 7 extending substantially vertically relative to said branch 2, said holes being aligned with each other and adapted to receive a corresponding end of the bearing support 3 or an end of a through axle 8 and pivotally carrying said bearing support 3.

The end plate of plates 5, 6, the axle 8 itself or the corresponding end of the bearing support 3, are provided with securement means known per se, which permit retaining said axle 8 or said corresponding end of the bearing support 3 in the oblong hole or holes 7 (aligned) of said end plate or plates 5, 6.

According to another characteristic of the present invention, the stirrup 1 is characterized in that between the end plates 5, 6 of each branch 2 is disposed a means 9 for limitation and shock absorption of the vertical or substantially vertical displacement of the bearing support 3 relative to said branches 2 of the stirrup 1.

This means 9 for shock absorbing and limitation of the vertical or substantially vertical displacement of the bearing support 3 relative to said branches 2 of the stirrup 1, can be in the form, for example, of a cylindrical receptacle closed at its ends and open on its two opposite lateral sides into which two springs, disposed on opposite sides, which is to say above and below the axle 8 or the corresponding lug, ensure shock absorption and/or limitation of the vertical movement or substantially vertical movement of the bearing support 3. This cylindrical receptacle can for example be welded to a single end plate or, as the case may be, welded between two facing end plates 5, 6.

Figure 2:
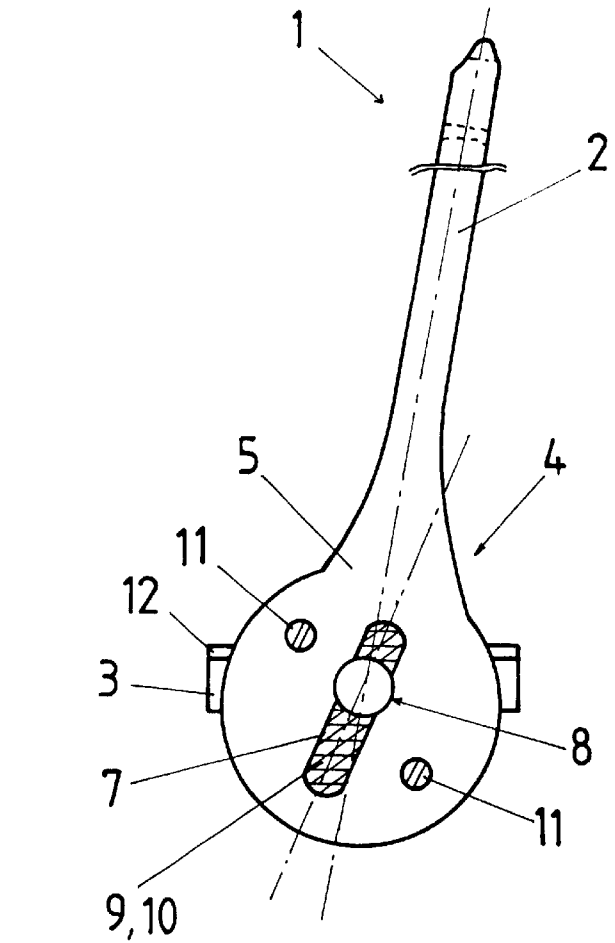
FIG. 2 is a side view of the exterior of the stirrup of FIG. 1.
Figure 4:
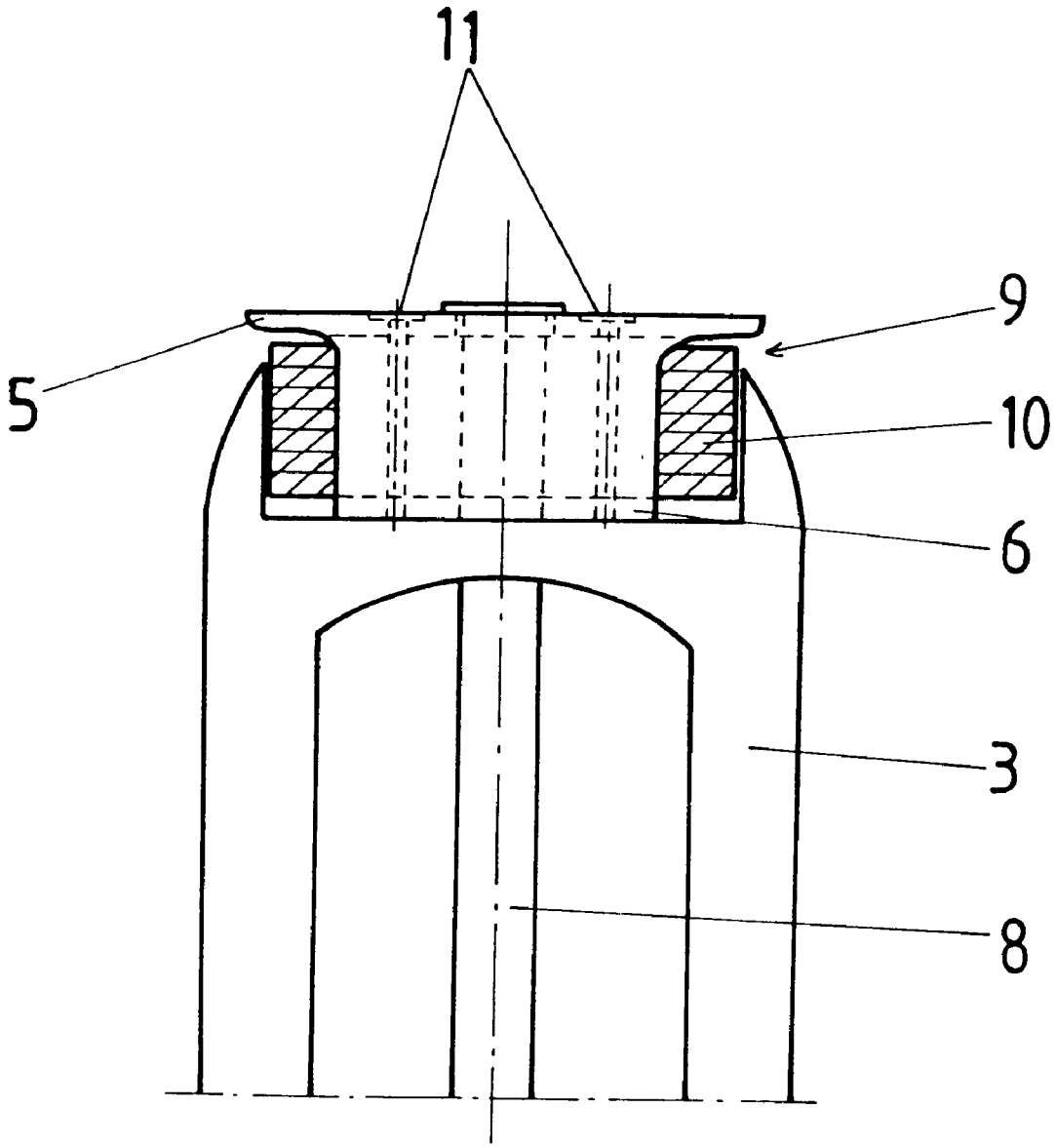
FIG. 4 is a fragmentary top plan view of the stirrup of FIG. 1.

Another embodiment shown in FIGS. 1, 2 and 4, shows that to maintain the means 9 on the terminal plate or between the two superposed terminal plates, said means 9 for limiting and shock absorbing for the bearing support 3, can be fixed on or between the end plates 5, 6 of each branch 2 by screws 11 or the like.

In a modified embodiment, the elasticity of the limiting and shock absorbing means 9 can be adjusted or selected to be different in the two branches 2. Thus, the bearing support 3 can be selected as being more movable from the side where the elasticity of means 9 is more important.

In the preferred embodiment mentioned and as will be seen clearly in FIGS. 1 to 4, the means 9 for limitation and shock absorption of the vertical or substantially vertical displacement of the bearing support 3, can be in the form of a resilient cushion 10 made of an elastic and/or resilient material through which passes the corresponding end of the bearing support 3 or the end of the through axle 8 and pivotally supporting said bearing support 3.

So as to guarantee an effective limitation and optimum shock absorption by means of the resilient cushion 10, it is provided that the dimensions of the hole in the resilient cushion 10, through which passes the corresponding end of the bearing support 3 or the end of the axle 8 of the bearing support 3, be substantially the same as those of the corresponding end of the bearing support 3 or the end of the axle of the bearing support 3.

In this way, the play between the axle 8 and the resilient cushion 10 will be reduced to the minimum and the resilient material can completely fulfill its role of limiting and/or shock absorbing the displacement of the axle 8 or of the corresponding end of the bearing support 3 in the oblong hole of the slot 7.

In this way, the play between the axle 8 and the resilient cushion 10 will be reduced to the minimum and the resilient material can completely fulfill its role of limiting and/or shock absorbing the displacement of the axle 8 or of the corresponding end of the bearing support 3 in the oblong hole or slot 7.

The end plate or plates 5, 6 made of harder material (stainless steel, bronze . . . ) than the material of the means 9 have a geometry which, on the one hand, permits vertical displacement of the axle or of the end of the bearing support 3 via the dimensions of the oblong hole or slot 7 and, on the other hand, the pivotal movement of the bearing support 3 about its axis, by means of the side walls of the means 9, so as preferably to avoid any unfavorable phenomenon of blockage in the abutment.

It is only under conditions of extreme pivoting, or after too great wear on the means 9, that the side edge of the internal plate 6 can encounter the protuberant end 3' about which the bearing support 3 pivots (compare FIG. 4, in which the branch 2 has not been represented for purposes of clarity)

Because of this, and apart from the case of too great wear, the blockage phenomenon in abutment of the bearing support 3 in the stirrup 1 of the present invention is not prevented in the cases in which such blockage can be necessary to retain an end movement of the foot of the rider and to permit him to regain control.

The pivoting of the bearing support 3 is therefore not as a general rule and except in really extreme cases, limited by the internal end plate 6 but is damped by the limiting and shock absorbing means 9 of vertical or substantially vertical displacement of the bearing support 3 relative to said branches 2 of the stirrup 1.

The material used for the resilient cushion 10 can be selected from the group of elastic and/or resilient synthetic plastic materials as well as the group of elastic and/or resilient materials of natural origin. In particular, the resilient material of the resilient cushion 10 can be selected from the group of shock absorbing materials that have high resistance to wear and is preferably rubber.

As can be seen particularly from FIG. 2, the direction of the branches 2 and the direction of the oblong hole or of the slot 7 for vertical displacement of the corresponding end of the bearing support 3 or the end of the axle 8 of the bearing support 3 form an angle comprised between 10° and 40°, preferably equal to about 18°, the upper end of the slot 7 in the end plate 5 being directed toward the rider when the stirrup 1 is used, which is to say when the branches 2 of the stirrup 1 are vertical.

The presence of this angle gives numerous supplemental advantages: first of all, the angle promotes the pivoting of the bearing support 3 to the good side, which is to say so as to lower the heel of the rider, and renders the reverse destabilizing movement substantially impossible; then, in the descending phase of the jump and at the end of the latter, the angle formed between the back of the rider in optimum reception position and the perpendicular to the longitudinal axis of the trunk of the horse inclined forwardly before landing, is generally comprised between 10° and 40°. Because of this, the vertical pressure is offset by the same angle thanks to the stirrup 1 according to the present invention.

Moreover, FIG. 1 also shows that the bearing support 3 can be provided with an interchangeable insert 12 known per se, of rubber material comprising skid patterns to ensure better adherence between the metallic bearing support 3 and the boot of the rider.

Following the example of parabolic skis or tennis racquets with a large mesh, the stirrup 1 of the present invention can be used in equestrian teaching, particularly to facilitate apprenticing beginners and rendering their lessons more comfortable and safe, and permitting them to make more rapid progress.

Of course, the invention is not limited to the embodiment described and shown in the accompanying drawings. Modifications remain possible, particularly as to the construction of the various elements or by substitution of technical equivalents, without thereby departing from the scope of protection of the invention.

What is claimed is:

1. A stirrup for horseback riding comprising two branches connected to the ends of a bearing support for the foot of the rider mounted pivotably about an axle connecting the two branches; said bearing support being structured and mounted to allow vertical or substantially vertical linear displacement relative to said branches of the stirrup.

2. The stirrup according to claim 1, wherein each branch comprises at its end at least one plate comprising an oblong hole or slot extending substantially vertically relative to said branches, and adapted to receive a corresponding end of the bearing support or an end of an axle passing through and carrying pivotally the bearing support.

3. The stirrup according to claim 2, wherein the direction of the branches and the direction of the oblong hole or slot of vertical displacement of the corresponding end of the bearing support or the end of the axle of the bearing support form an angle comprised between 10° and 40°, the upper end of the slot in the end plate being directed toward a rider when the stirrup is used, and when the branches of the stirrup are vertical.

4. The stirrup according to claim 3, wherein the angle is about 18°.

5. The stirrup according to claim 1, wherein each branch comprises at its end two end plates, each comprising an oblong hole or slot extending substantially vertically relative to said branch, said holes being aligned with each other and adapted to receive a corresponding end of the bearing support or an end of a through axle and carrying pivotally the bearing support.

6. The stirrup according to claim 5, wherein between the end plates of each branch is disposed a means for limitation and shock absorbing of the vertical or substantially vertical linear displacement of the bearing support relative to said branches of the stirrup.

7. The stirrup according to claim 6, wherein the means for limitation and shock absorbing of the vertical or substantially vertical linear displacement of the bearing support is fixed on or between the end plates of each branch by screws.

8. The stirrup according to claim 6, wherein the elasticity of the means for limitation and shock absorbing is different in the two branches.

9. The stirrup according to claim 6, wherein the means for limitation and shock absorbing of the vertical or substantially vertical linear displacement of the bearing support comprises an elastic cushion of an elastic and/or resilient material, through which passes the corresponding end of the bearing support or the end of the through axle pivotally supporting the bearing support.

10. The stirrup according to claim 9, wherein the dimensions of the hole in the resilient cushion through which passes the corresponding end of the bearing support or the end of the axle of the bearing support, are substantially the same as those of the corresponding end of the bearing support or of the end of the axle of the bearing support.

11. The stirrup according to claim 9, wherein the resilient material of the resilient cushion is rubber.

12. The stirrup according to claim 6, wherein the pivoting of the bearing support is not limited by the internal end plate but is shock absorbed by the means for limitation and shock absorption of the vertical or substantially vertical linear displacement of the bearing support relative to said branches of the stirrup.

* * * * *